US011653149B1

(12) United States Patent
Diaz

(10) Patent No.: US 11,653,149 B1
(45) Date of Patent: May 16, 2023

(54) SYMMETRICAL CUBOCTAHEDRAL SPEAKER ARRAY TO CREATE A SURROUND SOUND ENVIRONMENT

(71) Applicant: Christopher Lance Diaz, Santa Maria, CA (US)

(72) Inventor: Christopher Lance Diaz, Santa Maria, CA (US)

( * ) Notice: Subject to any disclaimer, the term of this patent is extended or adjusted under 35 U.S.C. 154(b) by 0 days.

(21) Appl. No.: 17/474,967

(22) Filed: Sep. 14, 2021

(51) Int. Cl.

| | |
|---|---|
| ***H04R 5/02*** | (2006.01) |
| ***H04S 7/00*** | (2006.01) |
| ***H04R 3/00*** | (2006.01) |
| ***H04R 5/027*** | (2006.01) |

(52) U.S. Cl.
CPC ..... *H04R 5/02* (2013.01); *H04R 3/005* (2013.01); *H04R 5/027* (2013.01); *H04S 7/30* (2013.01); *H04R 2201/023* (2013.01); *H04R 2201/401* (2013.01); *H04R 2430/20* (2013.01); *H04S 2420/11* (2013.01)

(58) Field of Classification Search
None
See application file for complete search history.

(56) References Cited

U.S. PATENT DOCUMENTS

| | | | | |
|---|---|---|---|---|
| 3,944,747 | A * | 3/1976 | Eilers | H04H 20/89 381/5 |
| 2004/0264704 | A1* | 12/2004 | Huin | H04S 7/301 381/59 |
| 2016/0192066 | A1* | 6/2016 | Benattar | H04R 1/1041 381/91 |
| 2016/0195923 | A1* | 7/2016 | Nauseef | A47C 7/72 297/344.21 |
| 2016/0269848 | A1* | 9/2016 | Mitsufuji | H04S 7/307 |
| 2017/0055097 | A1* | 2/2017 | Dougherty | H04S 7/308 |
| 2017/0086008 | A1* | 3/2017 | Robinson | H04S 7/30 |
| 2021/0345060 | A1* | 11/2021 | Robinson | H04S 7/307 |

* cited by examiner

*Primary Examiner* — Duc Nguyen
*Assistant Examiner* — Assad Mohammed
(74) *Attorney, Agent, or Firm* — Plager Schack LLP; Mark H. Plager; Kara Verryt

(57) ABSTRACT

A system for generating surround sound is disclosed. The system may be used for replicating a sonic space that can be reproduced around an end user listener. Applications may include general rebroadcasting of an event or use in a virtual reality setting. The sound captured may be live sound or a recorded sound. The system includes microphones positioned in multiple positions on or proximate an audio source subject. Speakers are positioned relative to each other in a cuboctahedral arrangement around an acoustic point of reference. An audio processing unit connected wirelessly to the microphones processes individual signals from the microphones and transmits the individual signals to the plurality of speakers.

7 Claims, 3 Drawing Sheets

SYMMETRICAL CUBOCTAHEDRAL SPEAKER ARRAY TO CREATE A SURROUND SOUND ENVIRONMENT

CROSS REFERENCE TO RELATED APPLICATIONS

None.

BACKGROUND

The embodiments herein relate generally to audio systems and more particularly, to a symmetrical cuboctahedral speaker array to create a surround sound environment.

Current surround sound models use mathematics to simulate false versions of a sound field through multiple speakers. The approaches may unbalance the multi speaker mix which is ultimately perceived in stereo. For many applications, the resulting sound space for the end user is inadequate for an immersive experience.

SUMMARY

In one aspect of the subject technology, a system for generating surround sound is disclosed. The system includes microphones positioned in multiple positions on or proximate an audio source subject. Speakers are positioned relative to each other in a cuboctahedral arrangement around an acoustic point of reference. An audio processing unit connected wirelessly to the microphones processes individual signals from the microphones and transmits the individual signals to the plurality of speakers.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In general, embodiments of the present disclosure provide an acoustic system that generates surround sound. This system improves the current models by considering the relationships between ambient and directional sounds and how they impact a listener who hears in stereo with two ears. Aspects of the subject technology makes the improvement of using actual acoustics instead of psychoacoustics. The sonic space is treated as a complete environment, where three dimensions can be properly represented from any angle within the array of speaker outputs.

Figure 1:
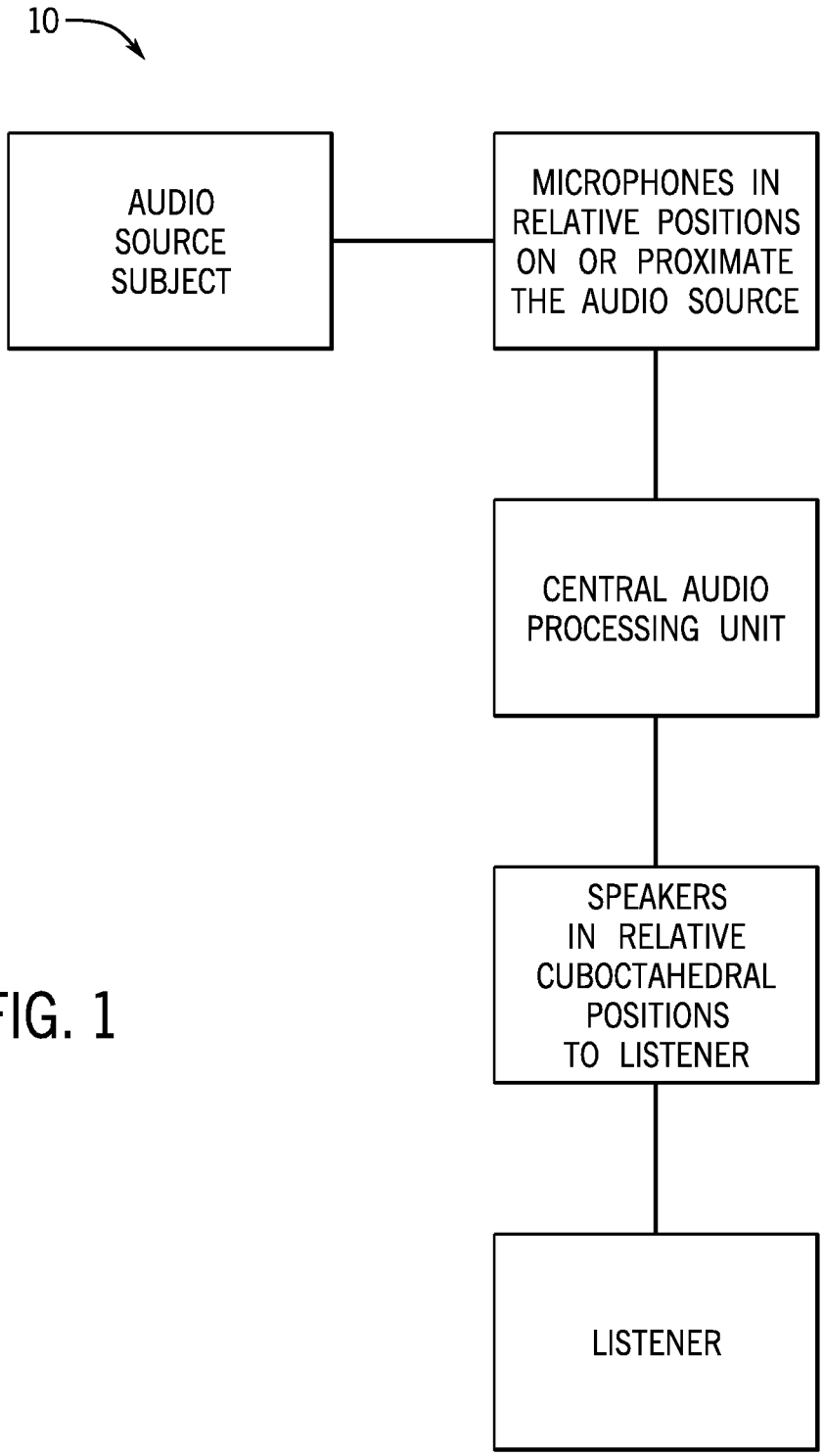
FIG. 1 is a block diagram of a system for generating spherical surround sound according to an embodiment of the subject disclosure.

Referring now to FIG. 1, a system 10 for generating a surround sound environment is shown according to an exemplary embodiment. In an exemplary embodiment, the subject technology may be implemented in a virtual reality system. The subject technology may receive audio signals from microphones placed in a surrounding arrangement around an audio source subject, to capture the sound from the subject in various directions from and/or around the subject. In some embodiments, the microphones may be symmetrically placed in polar pairs around the subject (as will be seen in more detail below in FIG. 3). As sound is captured, the environment around the audio source subject may be replicated in an environment surrounding a listener user so that the listener user experiences the same audio experience as the audio source subject. In an exemplary embodiment, the listener user is (or is located at) an acoustic point of reference within a sound re-creation space. A set of speakers may be positioned in a cuboctahedral arrangement around the listener. The sound captured by each microphone may be transmitted to a corresponding speaker to replicate the direction and characteristics of sound at the microphone location.

Some embodiments include a central audio processing unit. The central audio processing unit may determine which microphone is transmitting a signal. The processing unit may then determine which speaker may be associated with the microphone from which the signal was captured. The processing unit may forward the signal (where in some embodiments, signal processing, for example, smoothing/de-noising, amplification, etc.), to the speaker corresponding to the microphone to output the captured sound. In some embodiments, the microphones may use a cardioid polar pattern. Accordingly, the sound capture may be directional. As maybe appreciated, overlap in the type of sound captured may be avoided or minimized. Even if there is a slight overlap using cardioid microphones, (usually very little if angles are properly calibrated), there is unlikely to be a stereo effect, since such microphones will completely avoid the directions of the microphones on the other side of the audio source subject. The subject technology will create a sonic field where the location of the sound is actually more accurately represented by how it behaves in real space. The polar opposing microphones mean that any "bleed" where if a sound were to hit all twelve microphones will only create a true representation of the actual reverb that allowed it to happen. Those of ordinary skill in the art will understand that the central audio processing unit may be controlled by software embodiments providing the operations described above.

As will be appreciated, in some aspects, the sound capture recreates a 360 degree, spherical audio space for the listener. While in some embodiments, the listener may, by default, experience sound in the same directional perspective as the source, the listener may also experience a different directional sound perspective by changing the direction they face thereby picking up sounds the audio source subject may not pick up because of the different perspectives.

Figure 2A:
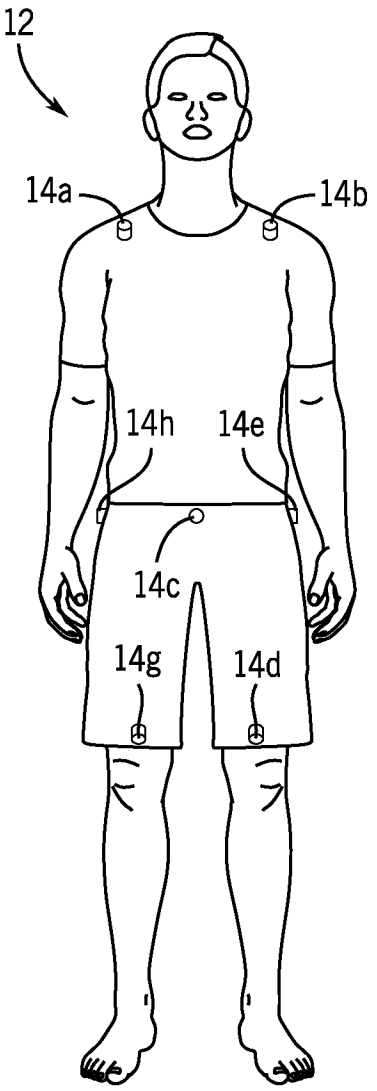
FIG. 2A is a diagrammatic front view of microphone placement on a person according to an embodiment of the subject disclosure.
Figure 2B:
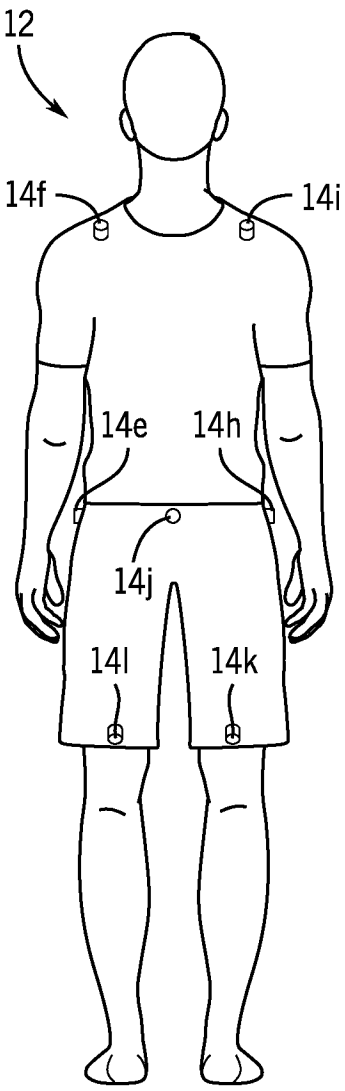
FIG. 2B is a diagrammatic rear view of microphone placement on a person according to an embodiment of the subject disclosure.
Figure 2C:
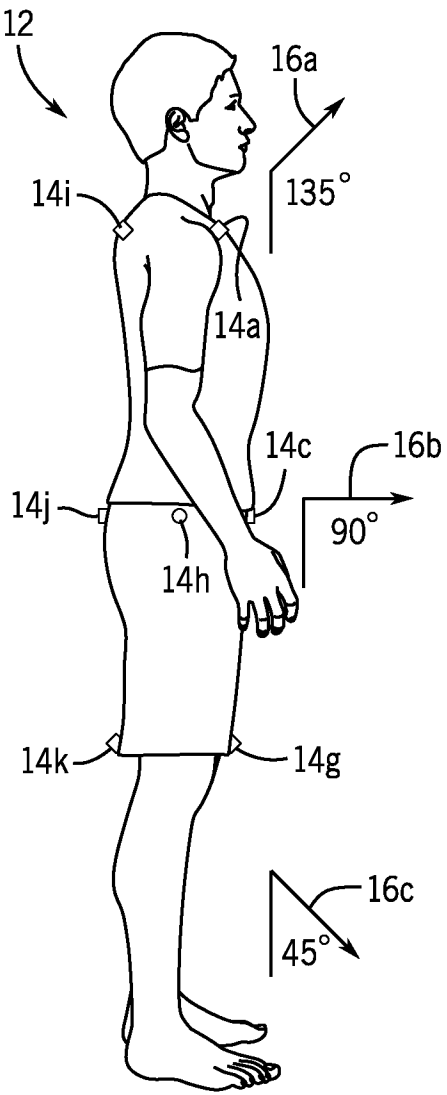
FIG. 2C is a diagrammatic side view of microphone placement on a person according to an embodiment of the subject disclosure.

As an illustrative embodiment, one may use the subject technology to replicate a virtual environment surrounding a professional athlete during competition. Referring to FIGS. 2A, 2B, and 2C, the audio source subject (for example, the athlete) may be mic'ed up (microphones may be placed on the person) according to embodiments. As the athlete engages in play on the court or field, a television broadcast may replicate the sound environment of the game using the subject athlete as the audio source subject 12 so that the listening viewer, hears the game from the point of perspective of the athlete. In one embodiment, the microphones (14*a*, 14*b*, 14*c*, 14*d*, 14*e*, 14*f*, 14*g*, 14*h*, 14*i*, 14*j*, 14*k*, and 14*l*) may be attached to locations on the audio source subject 12 that may correspond to a projected cuboctahedral space in the array of corresponding speakers (described below), which provides the symmetry that represents the three dimensions in which a listener user experiences sound. In embodiments, each speaker may be equidistant from adjacent speakers in the arrangement. The distance from one speaker to an adjacent speaker may be the same distance between the acoustic point of reference (the center of the arrangement where the listener is typically located), and each speaker in the array of speakers. Each microphone has a corresponding microphone aimed in an opposing direction, creating polar pairs that represent two dimensions at three different levels; these levels create the three-dimensional space. Each level of microphones (shoulders, waist, knees) create a polar x/y axis that rotates around the center of the audio source which is translated by the array of speakers with sound equally placed around a listener with respect to representing each dimension at every point in the array. This allows for left/center/right, up/center/down, and front/center/back sonic experiences that correspond to XYZ positioning where all three dimensions can be combined to create very specific aural placements. The microphones may generally be placed in an upper area, mid area, and lower area arrangement on the audio source subject 12. In an example arrangement, the microphones may be positioned as follows:

- 14*a* on an upper right front portion of a torso of the person, (for example, the front of the right shoulder),
- 14*b* on an upper left front portion of the torso, (for example, the front of the left shoulder),
- 14*i* on an upper right rear portion of the torso, (for example, the back of the right shoulder),
- 14*f* on an upper left rear portion of the torso, (for example, the back of the left shoulder),
- 14*c* on a lower front portion of the torso, (for example, proximate the navel),
- 14*j* on a lower rear portion of the torso, (for example, proximate the sacrum),
- 14*h* on a lower right side portion of the torso, (for example, the right hip),
- 14*e* on a lower left side portion of the torso, (for example, the left hip),
- 14*g* on a frontal, right side lower extremity, (for example, the front of the right leg),
- 14*d* on a frontal, left side lower extremity, (for example, the front of the left leg),
- 14*k* on a rear, right side lower extremity, (for example, the back of the right leg), and
- 14*l* on a rear, left side lower extremity (for example, the back of the left leg).

The upper microphones (14*a*, 14*b*, 14*i*, and 14*f*) may be disposed to point generally upward. For example, relative to a central axis running down the center of the person from the head through the body to the feet, the upper microphones may point at an angle 135 degrees from that central axis. The upper microphones would thus capture sound in an upper third of a spherical area around the audio source. The mid area microphones (14*c*, 14*j*, 14*h*, and 14*e*) may point straight out from the person approximately 90 degrees from the central axis. The mid area microphones may capture a middle third of the spherical area sound around the audio source 12. The lower microphones (14*g*, 14*d*, 14*k*, and 14*l*) may point generally downward, for example, 45 degrees from the central axis to capture sound in the lower third of the spherical area surrounding the audio source 12.

Figure 3:
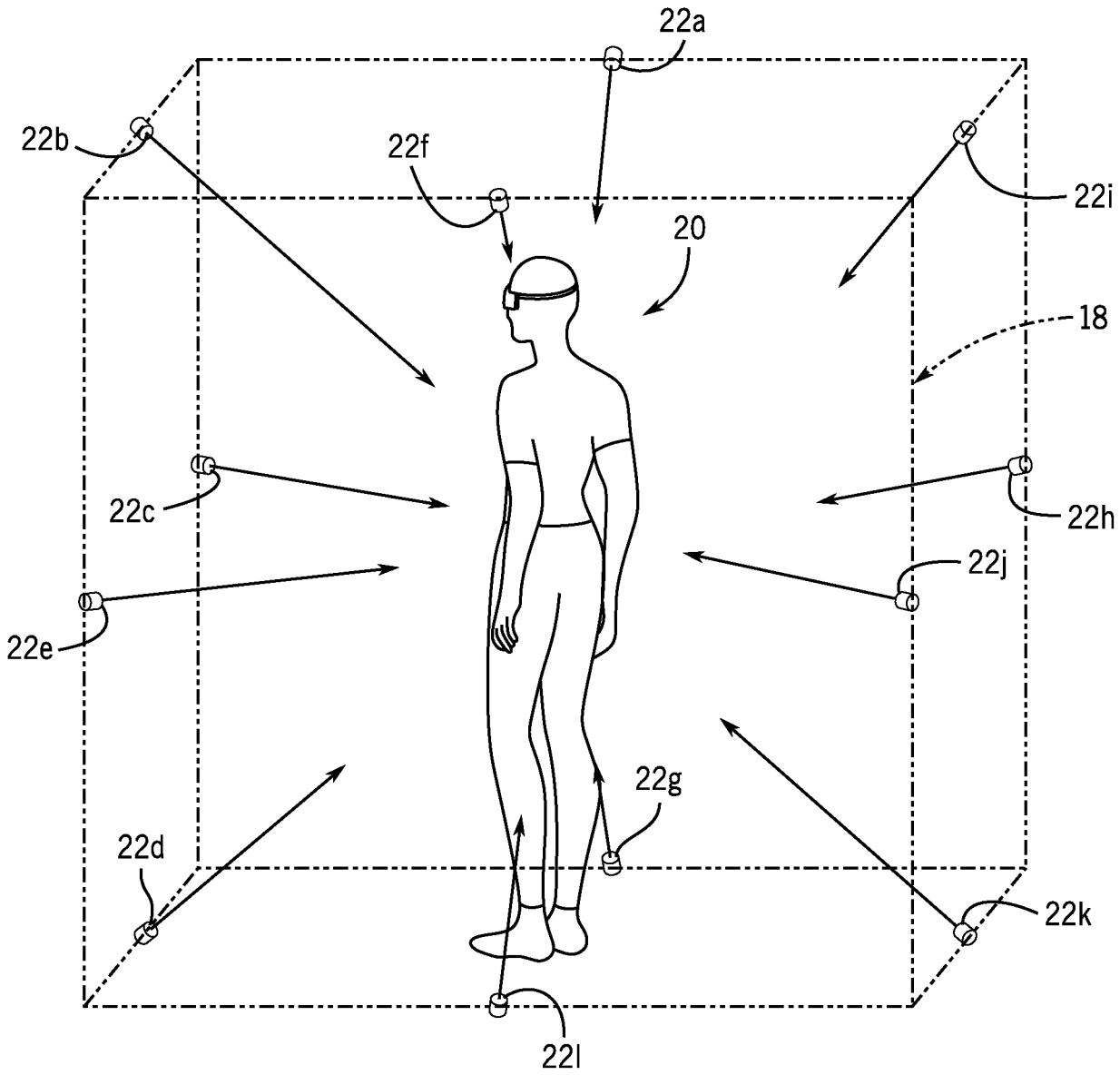
FIG. 3 is a perspective diagrammatic view of speaker placement relative to a receiving end user in the system according to an embodiment of the subject disclosure.

FIG. 3 shows a translation of the sound captured by the speaker system as replicated in a cuboctahedral space 18. A listener end user 20 may be positioned in an acoustic point of reference. In some embodiments, the acoustic point of reference may be centralized within the cuboctahedral space 18. In other embodiments, the acoustic point of reference may be centered on the user 20. The speaker system may include a plurality of speakers (22*a*, 22*b*, 22*c*, 22*d*, 22*e*, 22*f*, 22*g*, 22*h*, 22*i*, 22*j*, 22*k*, and 22*l*). In an exemplary embodiment, the microphones (14*a*, 14*b*, 14*c*, 14*d*, 14*e*, 14*f*, 14*g*, 14*h*, 14*i*, 14*j*, 14*k*, and 14*l*) are in a one-to-one direct relationship with a corresponding one of the speakers (22*a*, 22*b*, 22*c*, 22*d*, 22*e*, 22*f*, 22*g*, 22*h*, 22*i*, 22*j*, 22*k*, and 22*l*). For example, the sound captured by microphone 14*a* is output by speaker 22*a*. The sound captured by microphone 14*b* is output by speaker 22*b*, and so on. In an exemplary embodiment, each one of the speakers (22*a*, 22*b*, 22*c*, 22*d*, 22*e*, 22*f*, 22*g*, 22*h*, 22*i*, 22*j*, 22*k*, and 22*l*) is positioned relative to each other in a cuboctahedral arrangement. In some embodiments, each speaker may be positioned at a mid-point of an edge of an imaginary cuboctahedral space surrounding the end user 20. The speakers (22*a*, 22*b*, 22*c*, 22*d*, 22*e*, 22*f*, 22*g*, 22*h*, 22*i*, 22*j*, 22*k*, and 22*l*) may be equidistant from each other. In some embodiments, the speakers (22*a*, 22*b*, 22*c*, 22*d*, 22*e*, 22*f*, 22*g*, 22*h*, 22*i*, 22*j*, 22*k*, and 22*l*) may be pointed at a 45 degree angle toward the center of the space. The angle may be based on the surface the listener/recorder is standing on as the datum point. An outline of the imaginary cuboctahedral space is shown in broken lines within FIG. 3. While the speakers (22*a*, 22*b*, 22*c*, 22*d*, 22*e*, 22*f*, 22*g*, 22*h*, 22*i*, 22*j*, 22*k*, and 22*l*) are not shown attached to anything in particular, it will be understood that the speakers may be attached to some supporting frame, which has been left out for the sake of clarity in the illustrations. For example, the speaker system may be attached to a virtual reality cave or positioned on walls of a room in the arrangement disclosed. In addition, embodiments may include wired speakers (but the wires are omitted for sake of illustration) or wireless as shown. In addition, while the microphones and speakers are not shown physically connected to the central audio processing unit of FIG. 1, it will be understood that the electronic elements in the figures may be connected by a network.

When the sound is output by respective speakers (22*a*, 22*b*, 22*c*, 22*d*, 22*e*, 22*f*, 22*g*, 22*h*, 22*i*, 22*j*, 22*k*, and 22*l*), the user 20 may hear the output as a replication of the environment surrounding the audio source 12 and with each speaker (22*a*, 22*b*, 22*c*, 22*d*, 22*e*, 22*f*, 22*g*, 22*h*, 22*i*, 22*j*, 22*k*, and 22*l*) providing sound from the same direction as captured by the source microphone (14*a*, 14*b*, 14*c*, 14*d*, 14*e*, 14*f*, 14*g*, 14*h*, 14*i*, 14*j*, 14*k*, and 14*l*).

In a further illustrative embodiment, the game experience may be replicated in a virtual reality setting. The subject technology may generate the audio component of a virtual space. In some embodiments, the end user may be experiencing the game (athletic competition), from a central (for example, first person) point of view (which may be the athlete's perspective). While the end user is generally not part of the system's subject technology, in some embodiments, the subject technology may include a user worn device (as illustrated in FIG. 3) compatible with the virtual reality system (for example, a head mounted unit). A virtual reality engine may process the audio captured around the athlete so that the end user experience's the sound of the game firsthand from the athlete's experience. As mentioned earlier, in some embodiments, the end user may stray from the athlete's position and experience an audio perspective that is offset from the current location of the athlete. If the listener moves out of the direct center of the speaker array, they will lose synchronicity with the broadcast/recorded material, much in the same way they would alter their perception if they watched their TV at an odd angle, or removed one earbud while listening to stereo music. The lister should not lose sync with the person who has recorded or is broadcasting the sound if they maintain their position in the center facing the speakers that correspond to the proper microphones. They should also be able to turn their heads and hear the surround sound change much in the same way that it does in real life when one changes the physical positioning of their head. This may mimic how visual virtual reality adapts to how the viewer turns their head and sees different scenery. However, once stationary walking devices are introduced (like the Virtuix Omni, for example), the listener/gamer could enter a fixed audio world that adapts to their location within the virtual environment. While the illustrative example of a professional athlete engaging in a sport was used as a helpful point of context, it will be understood that the subject technology may be used in other applications that bring the audio experienced by a different source subject to the end user. Some embodiments may replicate the sound around inanimate or immobile objects to replicate a scene that changes around the subject (for example, a nature scene or a theatrical setting where the point of acoustic reference is not an active part of the setting).

As will be appreciated, aspects of the subject disclosure leverage a unique symmetrical property found only in the cuboctahedron. This shape allows for a three-dimensional spherical placement of speakers, while maintaining perfect symmetry around the listener and all being equidistant from each other. When the components of the subject technology are assembled in as described above, it is possible to transmit an entire sonic space to anywhere else on the planet. The multiple speakers can be directly linked to the multiple microphones recording system for both recorded and live experiences. By broadcasting different spaces, experiencers can then be surrounded by a sound field created completely by a 360° approach. This can be used for VR video games and film, but also for live sports broadcasts or for new forms of vlog style media creation and publishing. By using this specific array, the sonic space is not necessarily captured and transmitted in stereo, the sonic space is captured and rebuilt in any array tuned to a specific broadcast, so the listener and the mind are doing the conversion. It is the most efficient way to partition the space, by way of bisecting the sides of a perfect cube, and the 12 speakers allow for a multitude of mixing styles by way of its state as a highly composite number. For instance, stereo mixes can now be played back in over 100 new perfectly symmetrical manners that differ from the traditional left/right playback.

As will be appreciated by one skilled in the art, aspects of the disclosed invention may be embodied as a system, method or process, or computer program product. Accordingly, aspects of the disclosed invention may take the form of an entirely hardware embodiment, an entirely software embodiment (including firmware, resident software, microcode, etc.) or an embodiment combining software and hardware aspects that may all generally be referred to herein as a "user interface," "module," or "system." Furthermore, aspects of the disclosed technology may take the form of a computer program product embodied in one or more computer readable media having computer readable program code embodied thereon.

Aspects of the disclosed invention are described above (and/or below) with reference to block diagrams of methods, apparatus (systems) and computer program products according to embodiments of the invention. It will be understood that each block of the block diagrams, and combinations of blocks in the flowchart illustrations and/or block diagrams, can be implemented by computer program instructions. These computer program instructions may be provided to the processor of a computer system/server, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

The audio processing unit of the present disclosure may be for example, a special purpose circuit designed for processing the audio signals of the subject technology. or in some embodiments, the audio processing unit may be a computer system or server with executable programming instructions resident on the system/server for processing the audio signals as described herein.

The components of the computer system/server may include one or more processors or processing units, a system memory, and a bus that couples various system components including the system memory to the processor. The computer system/server may be for example, personal computer systems, tablet devices, mobile telephone devices, server computer systems, handheld or laptop devices, multiprocessor systems, microprocessor-based systems, set top boxes, programmable consumer electronics, network PCs, dedicated network computers, and distributed cloud computing environments that include any of the above systems or devices, and the like. The computer system/server may be described in the general context of computer system executable instructions, such as program modules, being executed by the computer system. The computer system/server and audio processing may be practiced in distributed cloud computing environments where tasks are performed by remote processing devices that are linked through a communications network. In a distributed cloud computing environment, program modules may be located in both local and remote computer system storage media including memory storage devices.

The computer system/server may typically include a variety of computer system readable media. Such media could be chosen from any available media that is accessible by the computer system/server, including non-transitory, volatile and non-volatile media, removable and non-removable media. The system memory could include one or more computer system readable media in the form of volatile memory, such as a random-access memory (RAM) and/or a cache memory. By way of example only, a storage system can be provided for reading from and writing to a non-removable, non-volatile magnetic media device. The system memory may include at least one program product having a set (e.g., at least one) of program modules that are configured to carry out the functions of identifying audio signals, identifying audio signal microphone sources, processing audio signals for retransmission (for example, processing the signal for the type of listening application including immersive static listener positioning (such as theater, CAVE, and gaming seating systems), virtual reality systems, and moving replicated environments), identifying a speaker(s)

corresponding to a microphone source, and re-creating the source environment in the end user environment.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A system for generating surround sound, comprising:

a plurality of microphones positioned in multiple positions on or proximate an audio source subject;

a plurality of speakers positioned relative to each other in a cuboctahedral arrangement around an acoustic point of reference, wherein:

a position of each microphone is placed on a point of the audio source subject, and the point of the audio source subject represents an audio point source in the cuboctahedral arrangement of the speakers, each microphone is fixed on the point of the audio source subject, the audio source subject is a moving person, and the plurality of microphones are positioned on:

an upper right front portion of a torso of the person, an upper left front portion of the torso, an upper right rear portion of the torso, an upper left rear portion of the torso, a lower front portion of the torso, a lower rear portion of the torso, a lower right side portion of the torso, a lower left side portion of the torso, a frontal, right side lower extremity, a frontal, left side lower extremity, a rear, right side lower extremity, and a rear, left side lower extremity; and an audio processing unit connected wirelessly to the plurality of microphones, wherein the audio processing unit is configured to process individual signals from the plurality of microphones and transmit the individual signals to the plurality of speakers.

2. The system of claim 1, wherein each of the plurality of microphones is in a one-to-one relationship with a corresponding speaker.

3. The system of claim 1, wherein the audio processing unit is a virtual reality processing engine.

4. The system of claim 1, wherein a position of each speaker is arranged at a mid-point of an edge in the cuboctahedral arrangement.

5. The system of claim 1, wherein a position of each speaker is equidistant from an adjacent one of the speakers.

6. The system of claim 1, wherein each speaker is pointed in an angle toward the acoustic point of reference.

7. The system of claim 1, wherein a position of each speaker matches a source of direction for sound captured by a corresponding microphone.

* * * * *